United States Patent [19]

Wheeler et al.

[11] 4,456,189

[45] * Jun. 26, 1984

[54] CONTROLLED EXPANSION STRIP ACCUMULATOR

[75] Inventors: Donald J. Wheeler, Belton, S.C.; Christopher Cooper, Brunswick; Charles R. Krejsa, Northfield, both of Ohio

[73] Assignee: International Patents Limited, Grand Cayman, Cayman Islands

[ * ] Notice: The portion of the term of this patent subsequent to Oct. 18, 2000 has been disclaimed.

[21] Appl. No.: 380,531

[22] Filed: May 21, 1982

[51] Int. Cl.³ ..... B65H 17/42; B65H 75/02

[52] U.S. Cl. ..... 242/55; 226/118

[58] Field of Search ..... 242/55, 55.16, 55.17, 242/55.21, 55.19, 63, 78.1, 78.6, 78.7; 226/118, 119

[56] References Cited

U.S. PATENT DOCUMENTS

| | | | |
|---|---|---|---|
| 1,716,774 | 6/1929 | Halla | 242/55.21 |
| 1,799,713 | 4/1931 | Walker | 242/55 |
| 3,310,255 | 3/1967 | Sendzimir | 242/78.1 |
| 4,410,121 | 10/1983 | Wheeler et al. | 226/118 |

*Primary Examiner*—Stuart S. Levy
*Assistant Examiner*—Lloyd D. Doigan
*Attorney, Agent, or Firm*—Maky, Renner, Otto & Boisselle

[57] ABSTRACT

A strip accumulator characterized by a plurality of circumferentially arranged guide assemblies which positively define a spiral strip path for strip material with adjacent turns thereof being maintained in radially spaced relation, and a common drive for uniformly moving the strip guide assemblies to radially expand and contract the spiral path for the strip material for increasing and decreasing the length of accumulated strip material. In one embodiment, the guide assemblies each include a radially movable guide roll basket which contains and guides multiple turns of the strip material along the spiral path with adjacent turns being maintained in radially spaced relation, and uniform radial movement of the guide roll baskets is obtained by a common drive and drag brake assembly or alternatively by a radially extending drive worm in mesh with a rack in the guide roll basket. In another embodiment, the strip guide assemblies each include a radially extending strip guide and support worm which directly supports the strip thereon with adjacent turns thereof being maintained in radially spaced relation by the turns of the worm. Uniform rotation of the worms by a common drive assembly drives the strip turns radially inwardly and outwardly for filling and emptying of the accumulator.

24 Claims, 11 Drawing Figures

CONTROLLED EXPANSION STRIP ACCUMULATOR

This invention relates generally to a strip accumulator and, more particularly, to a strip accumulator by which a length of strip material being fed from a source of supply, such as an uncoiler, to a mill, machine or other apparatus which processes or uses the strip material, is stored in an expanding and contracting spiral coil so that the mill, machine or other apparatus can be kept running without interruption while the source of strip material is being replenished. Such a strip accumulator may be employed, for example, in a continuous processing line to allow strip material to be continuously fed through the line even while the tail end of the spent coil of the strip material is stopped to permit the lead end of a new coil of strip material to be welded or otherwise attached to such tail end.

BACKGROUND OF THE INVENTION

Strip accumulators heretofore have stored a length of strip material in an expanding and contracting spiral coil having a fixed number of turns with the strip material being fed to the inside of the spiral coil and withdrawn from the outside, or vice versa. Typically, the maximum diameter of the outermost turn of the spiral coil is determined by an outer containment ring or circular array of outer containment rollers, whereas the inner diameter of the innermost turn of the spiral coil is determined by an inner containment ring or circular array of inner containment rollers. Accordingly, the difference between the length of coil when fully expanded into engagement with the outer containment ring or rollers and when fully contracted against the inner containment ring or rollers determines the maximum reserve storage capacity of the accumulator for any given gauge and number of turns of the strip material.

It of course will be understood that the radial dimension of the space occupied by such given number of turns in the spiral coil when the turns are closely packed must be less than the difference between the maximum and minimum permissible radii of the spiral coil defined by the outer and inner containment rings or rollers.

Such inner and outer containment rings or rollers typically are mounted in the accumulator at respective fixed diameters. However, it is known to mount inner containment rollers for slight radial movement so that they can be radially retracted away from the contacted spiral coil just prior to resumption of strip feed-in to the inside of the spiral coil following attachment of a new coil of strip material to the end of the spent coil.

In one known type of strip accumulator disclosed in United Kingdom Patent Specification No. 1,386,250, an annular ring or array of long, thin, cylindrical rollers support a single spiral coil of strip material with the axis thereof oriented vertically, and such rollers are synchronously driven by individual variable speed electric motors to rotate the spiral coil of strip material supported thereon to facilitate feeding and withdrawal of the strip material from the spiral coil. The rollers extend radially, or may be slightly skewed, and slope downwardly and outwardly to urge the turns of the spiral coil stored thereon outwardly as the rollers rotate.

It also is known to guide the incoming strip material by a support cage mounted above the individually driven rollers and feed the strip material to the inside of the spiral coil and withdraw the strip material from the outside, or vice versa. Such support cage includes a driven pair of feed-in or pinch rollers and one or more pairs of fixedly mounted guide idler rollers which define a desired helical path of the strip material from the pinch rollers to the individually driven rollers supporting the spiral coil.

Although such an accumulator will operate satisfactorily, it is relatively expensive to manufacture and is subject to misoperation. In particular, the individually driven rollers and drives therefor are expensive, and sophisticated controls are requried to achieve proper synchronization of the rollers. Moreover, the turns of the spiral coil of strip material are not positively controlled, and undesirable interface friction exists between adjacent closely packed turns of the spiral coil, which may also cause the surfaces of the strip material to become marred, blemished or otherwise damaged as a result of the rubbing that occurs between adjacent turns of the spiral coil.

SUMMARY OF THE INVENTION

The present invention provides a strip accumulator having desirable operational characteristics which is relatively inexpensive and simple in construction. The strip accumulator eliminates the need for expensive individually driven drive rollers and sophisticated controls therefor, and provides for continuous positive control of the strip material with no interface friction between adjacent turns.

Briefly, a strip accumulator according to the invention is characterized by a plurality of circumferentially arranged guide assemblies which positively define a spiral strip path for strip material with adjacent turns thereof being maintained in radially spaced relation, and means for uniformly moving the strip guide assemblies to radially expand and contract the spiral path for the strip material. As the diameter of the spiral strip path is increased or decreased, the length of accumulated strip material proportionally increases or decreases. Accordingly, strip material may be withdrawn without continuous in-feed by uniformly moving the strip guide assemblies to effect radial contraction of the spiral strip path, such as during attachment of a new coil of strip to the tail end of a spent coil of strip. At all times during radial expansion and contraction of the spiral strip path, adjacent turns of the strip material are maintained in radially spaced relation whereby no interface friction exists between adjacent turns.

In one embodiment of the invention, the guide assemblies each include a guide roll basket which is mounted on a track for radial movement. The guide roll basket has mounted therein a plurality of radially spaced vertical guide rolls which contain and guide the strip material along the spiral path wherein adjacent turns are maintained in radially spaced relation, and radial lower strip edge support rolls which support the lower edge of each respective turn of the strip. Uniform radial movement of the guide roll baskets is obtained by a common drive and drag brake assembly connected to each basket by a bi-directional cable and capstan arrangement, such being operative to drive the baskets radially outwardly during filling and to place a drag on the baskets as they are moved radially inwardly during emptying of the accumulator. Also provided are idler guide roll baskets which are mounted for radial movement on respective tracks which may be the tracks for the driven guide roll baskets just preceding an entry guide roll basket whereat the strip is tangentially fed into the spiral strip path from a centrally mounted helix support cage. The idler guide roll baskets support the strip as it tangentially enters the spiral strip path, the strip at this point being free floating to permit radial expansion and contraction of the strip path. Idler guide roll baskets may also be provided at the strip exit of the accumulator to support the strip being withdrawn from the accumulator.

In a modification of this first embodiment, uniform radial movement of the guide roll baskets is obtained by radially extending drive worms which are in mesh with racks in the guide roll baskets. The drive worms are uniformly and commonly rotated to drive the guide roll baskets radially outwardly and inwardly for filling and emptying of the accumulator.

In another embodiment of the invention, the strip guide assemblies may each include a radially extending strip guide and support worm which directly supports the strip thereon with adjacent turns thereof being maintained in radially spaced relation by the turns of the worm. Uniform rotation of the worms by a common drive assembly drives the strip turns radially inwardly and outwardly for filling and emptying of the accumulator. Such common drive assembly may include rubber tires respectively drivingly connected to the worms and a common driven drum on which the rubber tires ride.

A preferred form of worm includes a worm shaft and a plurality of guide roll assemblies which are helically arranged around the worm shaft. Each guide roll assembly includes longitudinally spaced guide rolls that extend radially from the shaft axis and a longitudinally extending lower strip edge support roll.

Each worm also may be canted slightly to a radius of the accumulator so that the pitch line of the worm is substantially parallel to the strip supported thereon. This reduces rubbing between the worm and strip. Moreover, the worm may be mounted for limited rotation about a vertical axis, thus permitting the worm to be adjusted to match the pitch line thereof to the strip as the spiral coil of strip is expanded and contracted by the worm. Alternatively, the worm may consist of two or more worm segments that are radially and circumferentially staggered so that the pitch line of each segment may be substantially parallel to the spiral coil of strip that comes to be supported thereon during expansion and contraction of the spiral coil.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In the annexed drawings

FIG. 6 is a fragmentary vertical section taken substantially along the line 6—6 of FIG. 5;

DETAILED DESCRIPTION

As used herein, the term "vertical", "vertically", "horizontal", "horizontally", "radial", "radially", "normal", "perpendicular" and the like will mean, respectively, "vertical and substantially vertical", "vertically and substantially vertically", and so on, unless otherwise specifically stated.

Description of the FIGS. 1-4 Embodiment

Figure 1:
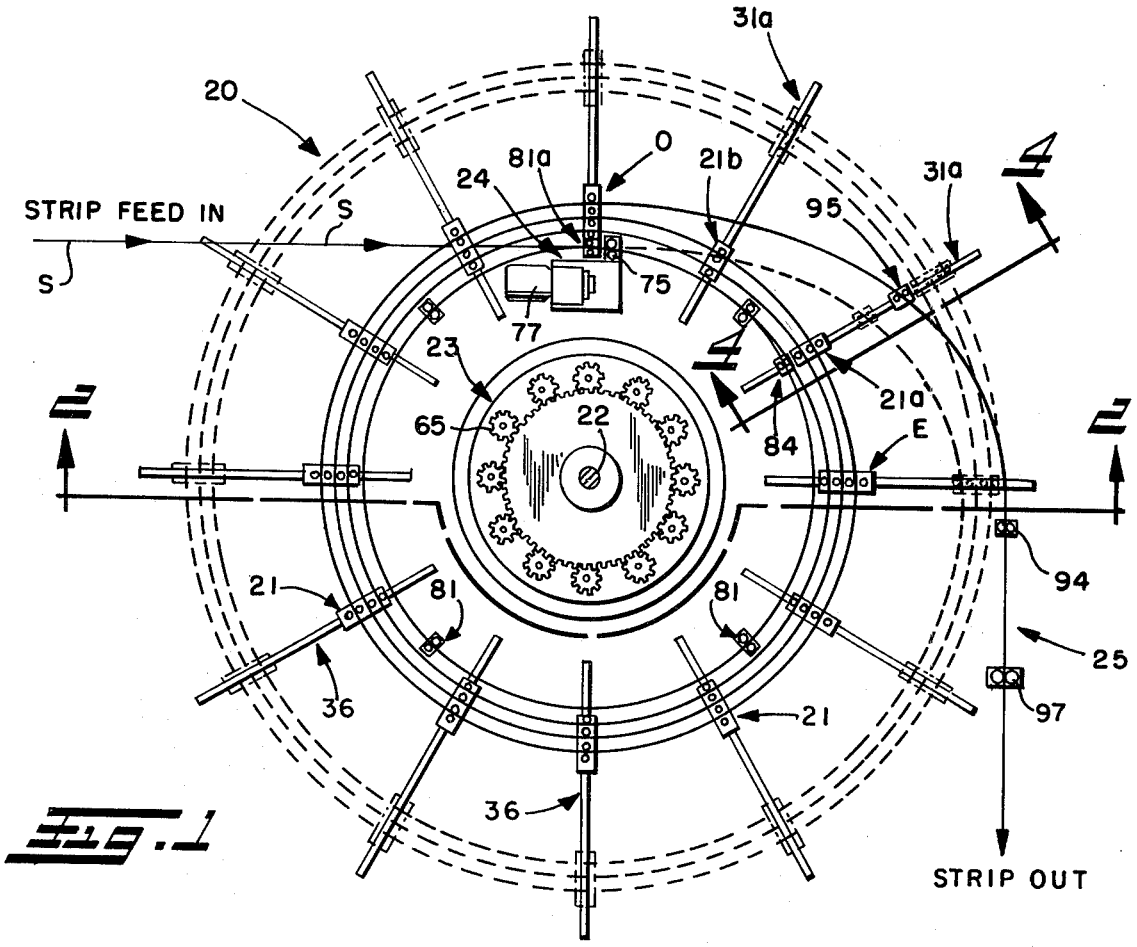
FIG. 1 is a schematic top plan view of a preferred embodiment of strip accumulator according to the present invention.
Figures 2, 3, 4, 5:
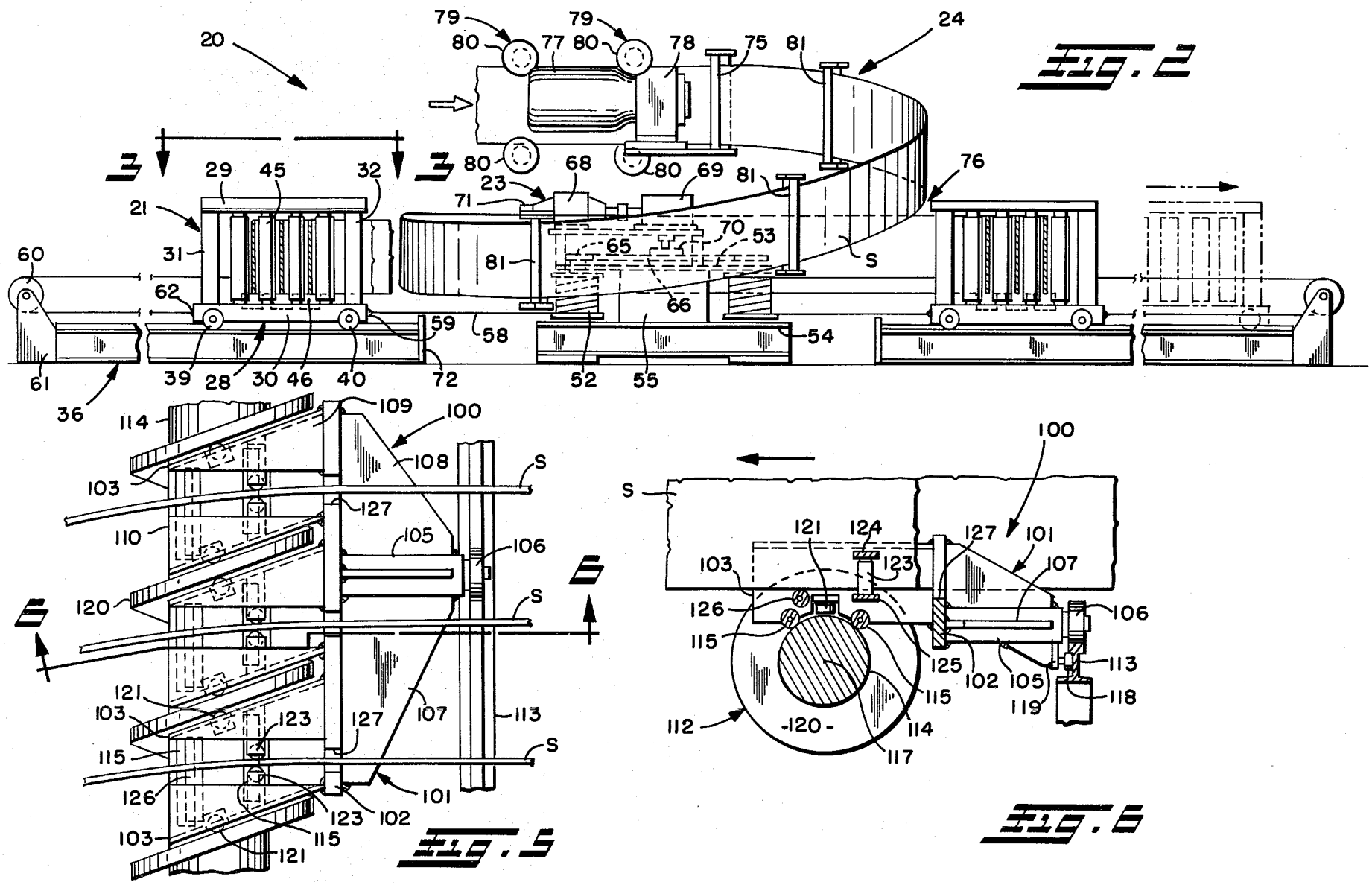
FIG. 2 is an enlarged vertical section through the accumulator of FIG. 1 taken substantially along the line 2—2 thereof.
FIG. 5 is a fragmentary top view of a modified form of the FIG. 1 accumulator illustrating, in particular, another form of strip guide basket assembly and drive therefor.

Referring now in detail to the drawings, and initially to FIGS. 1 and 2, the reference numeral 20 generally designates a strip accumulator in accordance with the present invention for storing a length of strip material, such as sheet metal strip S, taken from a coil, and supplying such strip material to a mill, machine or other apparatus without interruption.

As shown, the strip accumulator 20 comprises a plurality of strip guide basket assemblies which are commonly identified by reference numeral 21. The strip guide basket assemblies 21 are circumferentially arranged and uniformly radially movable with respect to the central vertical access 22 of the accumulator by a basket drive assembly 23. The strip guide basket assemblies together define a spiral path for the strip material S and contain, support and guide the strip material along such spiral strip path from a strip entry support cage 24 to a strip exit assembly 25.

In the illustrated embodiment of FIGS. 1 and 2, the strip guide basket assemblies 21 define a spiral path consisting of three turns with adjacent turns being maintained in radially spaced relation. Also in the illustrated embodiment, the strip guide basket assemblies number twelve and are preferably circumferentially equally spaced as shown. However, the helical path may consist of more or fewer turns, each adjacent turn being maintained in radially spaced relation, and there may be more or fewer guide basket assemblies depending for example on the size and type of strip material to be used.

The strip guide basket assemblies 21 generally are of like construction and accordingly like reference numerals are used to designate corresponding like elements of such assemblies.

Figure 3:
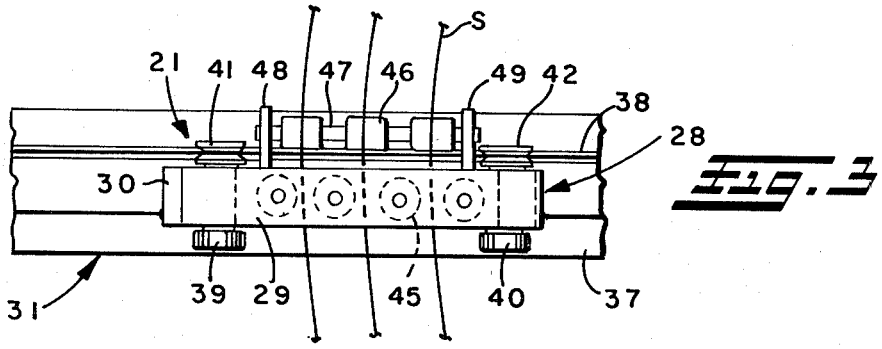
FIG. 3 is an enlarged fragmentary top view of a portion of the accumulator of FIG. 1 as seen from the line 3—3 of FIG. 2.

As best seen in FIGS. 2 and 3, each strip guide basket assembly 21 includes a fabricated horizontal roll support frame or carriage 28. The roll support carriage 28 may include radially elongate parallel top and bottom plates 29 and 30 interconnected at their radially inner and outer ends by vertical posts or uprights 31 and 32. In addition, the carriage may include a large triangular plate or gusset secured to the radially outer upright 32 and bottom plate 30 to rigidify the carriage.

The carriage 28 of each strip guide basket assembly 21 is supported for radial movement on a corresponding track 36. Each track 36 consists of parallel rails 37 and 38 which may be set in or otherwise fixedly secured to the foundation for the accumulator. One rail 37 preferably has a flat top flange on which rides the rollers 39 and 40 secured to one side of the bottom plate 30 of the carriage at the radially inner and outer ends thereof, whereas the other rail 38 may have a V-top flange on which rides correspondingly slotted captive rollers 41 and 42 secured to the other side of the bottom plate 30. Accordingly, the captive rollers 41 and 42 cooperate with the rail 38 to hold the carriage 28 against lateral movement with respect to the track 36. As the track radiates from the central vertical axis 22 of the accumulator as seen in FIG. 2, the carriage is thus constrained for radial movement which is effected by means of the basket drive assembly 23 as described hereinafter.

Still referring to FIGS. 2 and 3, each strip guide basket assembly 21 further includes a number of vertical guide rolls 45 which are journaled top and bottom between the top and bottom plates 29 and 30 of the roll support carriage 28. The guide rolls 45 are arranged radially in line with respect to the accumulator central axis 22 and closely spaced to contain and guide the turns of the strip material S in respective narrow paths therebetween with the guide rolls interposed between two adjacent turns of the strip material maintaining such turns in radially spaced relation. Also provided are radially extending lower strip edge support rolls 46. The edge support rolls may be journaled on a radially extending shaft 47 secured to one side of the bottom plate 30 by brackets 48 and 49. As shown, the edge support rolls are mounted adjacent the lower ends of respective adjacent pairs of the guide rolls 45 so as to support the lower edge of each respective turn of the strip.

Figure 4:
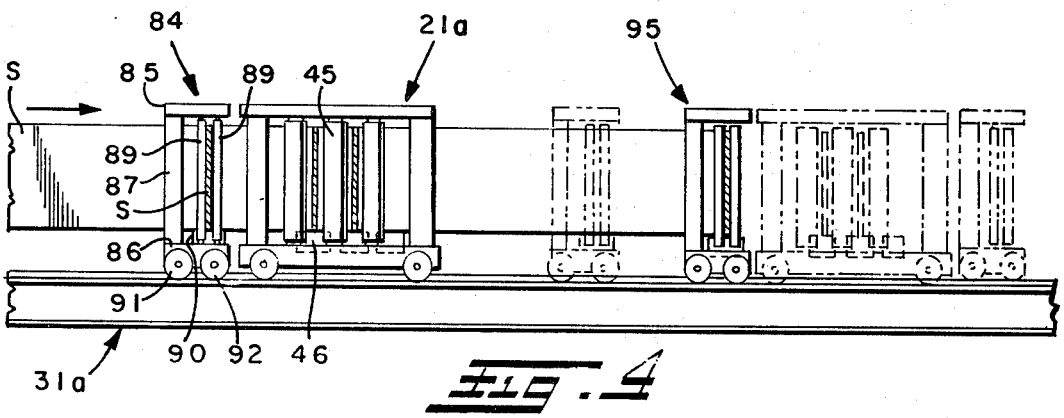
FIG. 4 is an enlarged fragmentary vertical section of the accumulator of FIG. 1 taken substantially along the line 4—4 thereof.

In the illustrated embodiment of FIGS. 1–3, since there are three turns of strip being maintained by the strip guide basket assemblies 21 in radially spaced relation, four guide rolls 45 and three edge support rolls 46 are provided in each basket assembly except for those designated 21*a* and 21*b* in FIG. 1. The basket assemblies 21*a* and 21*b* may be of like construction and, as seen in FIG. 4, the basket assembly 21*a* has only three guide rolls 45 and two associated edge support rolls 46 as the innermost and outermost turns must be free to float with respect to such basket assembly during radial movement thereof which is effected by the basket drive assembly 23.

Reference now being had to the basket drive assembly 23 and to FIGS. 1 and 2, such assembly may comprise a capstan 52 for each basket assembly 21. The capstan 52 has its top and bottom end journals supported by top and bottom circular journal plates 53 and 54. The top and bottom journal plates are maintained in vertically spaced relationship by a vertical cylinder 55 and are supported on a base 56 in the center of the accumulator.

As shown, such circular journal plates 53 and 54 support the capstans 52 in a circular array, each capstan being generally in radial alignment with the corresponding basket assembly 21. Wrapped around each capstan is a cable 58 having one end connected to the radially inner end of the support carriage 28 as at 59. The other end of the cable is trained about a pulley 60 journaled in a bracket 61 mounted at the radially outer end of the track 36 and is connected to the radially outer end of the support carriage as at 62. Accordingly, rotation of the capstan in one direction causes radial inward movement of the roll support carriage whereas rotation in the opposite direction causes radial outward movement of the roll support carriage.

The top end journal of each capstan 52 projects above the top circular plate 53 and has secured thereto a pinion 65. Each pinion associated with each capstan is in mesh with a common central gear 66 whereby rotation of such common gear effects uniform rotation of the pinions and accordingly the capstans coupled thereto, to cause uniform radial movement of the roll support carriages 28 through the bi-directional cables 58.

The common gear 66 may be drivingly connected to a motor 68 through a gear reducer 69 and a drag brake and clutch mechanism 70. As will be appreciated below, the motor need only operate to drive the roll support carriages 28 radially outwardly during filling of the accumulator. During emptying of the accumulator, i.e., during radially inward movement of the roll support carriages, the motor is disengaged by the clutch and the drag brake places a drag on the common gear so that the capstans will not freewheel and the cables fly as a result of the forces being exerted by the radially collapsing strip on the vertical frames as the strip is withdrawn from the accumulator at a rate faster than it is fed into the accumulator. If desired, a brake 71 also may be provided to hold the roll support carriages in their fully expanded condition, for example, so that the drive motor may be turned off during normal operation when strip material is fed into and withdrawn from the accumulator at equal rates Although suitable controls for the basket drive assembly 23 desirably are provided to control the end limits of movement of the roll support carriages 28 along the tracks 36, there additionally may be provided at the radially inner end of each rail a radially inner stop 72 which may define the smallest diameter of the accumulator and is selected so that no permanent deformaton of the stored strip will occur at such smallest diameter. The bracket 61 may function as a radially outer stop.

As seen in FIGS. 1 and 2, strip material S is fed into the spiral path of the accumulator by the entry support cage 24. The entry support cage 24 is mounted by suitable supports radially spaced from the center of the accumulator and may include a pair of feed-in or pinch rollers 75 which are sufficiently elevated above the guide basket assemblies 21 so that incoming strip at 76 clears the guide basket assemblies positioned therebeneath. The pinch rollers 75 are radially aligned and spaced adjacent one another and one may be driven by a motor 77 through speed reducer 78. Suitable guides 79 positioned upstream from the pinch rollers cooperate accurately to maintain the strip in a desired helical path that spirals downwardly to the entry of the spiral strip path of the accumulator. Such guides 79 may include one or more sets of vertically spaced grooved rollers 80 that are movable towards and away from each other for accommodating strips of different widths and for centering the strip.

The cage 24 may further include one or more pairs of guide idler rollers which are commonly designated by reference numeral 81. Such pairs of guide idler rollers preferably are skewed to vertical to define the desired helical path for the strip and reduce stress on the strip resulting from the weight of the strip.

As shown, the idler rollers 81 are set in the entry support cage 24 just inside the radially innermost position of the guide basket assemblies 21 and define a downwardly descending helical entry path consisting of one turn. In FIG. 1, with the pinch rollers 75 disposed at about twelve o'clock, the last pair of idler rollers 81*a* also are positioned at about twelve o'clock. After passing through the last pair of idler rollers 81*a*, the strip is free to float radially over a quarter turn thereof until it enters the entry guide basket assembly indicated at E in FIG. 1. During radial expansion and contraction of the guide basket assemblies, the strip over such quarter turn is free to assume the proper arcuate path for tangential exiting from the entry support cage 24 and tangential entry into the spiral path of the accumulator at entry basket assembly E.

As seen in FIGS. 1 and 4, an entry idler guide basket assembly 84 preferably is provided to insure that the strip assumes the proper arcuate path over the free floating quarter turn thereof so that no permanent deformation of the strip will occur. The idler guide basket assembly 84, being of a construction similar to that of the guide basket assemblies 21, includes top and bottom plates 85 and 86 which are interconnected by an upright 87. The idler guide basket assembly 84, however, includes only two vertical guide rolls 89 which are journaled top and bottom between the top and bottom plates 85 and 86. Th guide rolls 89 are radially in line with respect to accumulator central axis 22 and closely spaced to contain and guide the strip material S in a narrow path therebetween. Also provided is a radially extending edge support roll 90 journaled by suitable brackets to one side of the bottom plate 86. As shown in FIG. 4, the edge support roll is adjacent the lower ends of the guide rolls 89 so as to support the lower edge of the strip passing between the guide rolls.

The idler guide basket assembly 84 may be supported for radial movement on the same track 31*a* as the guide basket assembly 21*a* next preceding the entry guide basekt assembly E, and if so, it is located on such track radially inwardly of the guide basket assembly 21*a* as seen in FIG. 4. Like the guide basket assemblies 21, the idler guide basket assembly rides on the rails of the track as by means of rollers 91 and 92 and captive rollers (not shown). Accordingly, the idler guide basket assembly is held to the track against lateral movement and constrained for movement only along the track in a radial direction. Unlike the guide basket assemblies 21, which are uniformly radially moved by the basket drive assembly 23, the idler guide basket assembly 84 is freely radially movable, such movement being effected by the forces exerted by the free floating quarter turn of the strip passing therethrough. If desired, another idler guide basket assembly may be similarly provided in conjunction with the guide basket assembly 21*b* intermediate the guide basket assembly 21*a* and entry support cage 24.

Reference now being had to the strip exit assembly 25, such assembly may include a pair of idler guide rolls 94 located one quarter turn downstream from the exit guide assembly indicated at O in FIG. 1, just outside the radially outermost position of the entry guide basket assembly E. After exiting the exit guide basket assembly O, the strip is free to float radially over such quarter turn thereof until it passes through the idler guide rolls 94. During radial expansion and contraction of the guide basket assemblies, the strip over such quarter turn accordingly is free to assume the proper curved path for tangential exiting from the exit guide basket assembly O and tangential entry to and through the idler guide rolls 94.

As seen in FIGS. 1 and 4, an exit idler guide basket assembly 95 preferably is provided between the exit guide assembly O and idler guide rolls 94 to ensure that the strip assumes the proper arcuate path over the exiting free floating quarter turn thereof so that no permanent deformation of the strip will occur. The exit idler guide basket assembly, as seen in FIG. 4, may be constructed similarly to the entry idler guide basket assembly 84 and supported for radial movement on the same track 31*a* but radially outwardly of the guide basket assembly 21*a*. Also like the entry idler guide basket assembly 84, the exit idler guide basket assembly 95 is freely radially movable, such movement being effected by the forces exerted by the exiting free floating quarter turn of the strip. If desired, another exit idler guide basket assembly may be similarly provided in conjunction with the guide basket assembly 21*b*.

Referring now again to the strip exit assembly 25, such further may include a pair of pinch rolls 97 downstream from the idler guide rolls 94. The pinch rolls may be controllably driven by a motor (not shown) to provide a back tension for the mill. One of the pinch rolls preferably is fixed in position and directly connected to the motor whereas the other roll may be mounted in machine slides and connected to hydraulic cylinders or the like to provide a constant pinch pressure on the moving strip. The feed-in pinch rolls 75 of the strip entry support cage 24 may be similarly arranged.

Operation of the FIGS. 1–4 Embodiment

To initially load the accumulator 20, the strip material S may be fed initially from a coil between the feed-in pinch rolls 75 of the strip entry support cage 24 to provide the driving force for feeding the strip material into the accumulator to load the same. If the strip coil has its axis oriented horizontally as is typical, it will be necessary to turn the strip 90° from the horizontal to vertical before passing through the pinch rolls. The distance required for this turning operation must be sufficient to prevent any permanent deformation of the material. As such distance typically will be relatively long, intermediate strip turning stands should be provided to support and guide the strip material at selected intervals through such turning distance. In addition, the strip material leaving the strip coil initially may be fed through an uncoiler to straighten same prior to being fed into the accumulator.

From the feed-in rolls 75, the strip material S is guided along the helical entry path by the idler guide rolls 81 into the accumulator at the entry guide basket assembly E, after first passing through the entry idler guide basket assembly 84. From the entry guide basket assembly E, the strip material is passed between the guide rolls of the guide basket assemblies 21, and hence along the spiral path defined thereby. Strip material is fed into the accumulator until the leading end of the coil reaches the end of the spiral strip path at the exit guide basket assembly O whereupon the strip material is guided through the exit idler guide basket assembly 95, and then to and between the exit idler guide rolls 94 and then the pinch rolls 97. From the pinch rolls 97, the strip material may continue on to the mill of other apparatus for processing of the strip material.

If such start-up operation is performed with the guide basket assemblies 21 in their radially expanded condition, the accumulator would then be fully loaded. Otherwise, additional strip material may be fed into the accumulator as the guide basket assemblies are radially expanded to the phantom positions shown in FIGS. 1 and 2, at which time the accumulator is filled to maximum capacity.

During normal operation, the accumulator is maintained in its radially expanded condition, and strip material S is fed into the accumulator at approximately the same rate at which strip material is removed therefrom. However, should the rate of withdrawal of the strip material from the accumulator exceed the rate of in-feed, or the in-feed be stopped altogether, as when welding a new coil to replenish the supply of strip material, the reserve capacity of the accumulator will still permit withdrawal of the strip material without interruption. During such welding operation, the feed-in rollers 75 are stopped and the guide basket assemblies are permitted to move uniformly radially inwardly to reduce the respective diameters of the stored turns so as to supply from storage the additional required length of strip material. By proper selection of the size of the strip accumulator in relation to the speed of the mill processor or the like and the time required to weld on a new coil, the accumulator will be able to supply sufficient strip material to prevent interruption of the line during the welding operation. Of course, if the amount of additional strip material required should exceed the storage capacity of the accumulator, a suitable emergency stop should be provided to shut down the strip processing line at the appropriate time.

After a new coil has been welded on or otherwise attached to the tail end of the spent coil, strip material S again is fed into the accumulator by the feed-in rollers 75 which are then driven at a linear speed greater than that of the strip material being withdrawn. The rate of withdrawal is of course governed by the mill, processor or the like to which the strip material is being fed. As long as the rate of in-feed of the strip material is greater than the out-feed, the guide basket assemblies 21 may be uniformly expanded through operation of the drive motor 68. Such higher rate of in-feed may be continued until the accumulator is once again filled to capacity with the guide basket assemblies 21 at the radially outermost position shown in FIGS. 1 and 2 in phantom lines. At that time, the rate of in-feed of the strip material into the accumulator should be adjusted substantially to correspond to the rate of withdrawal therefrom so as to maintain the maximum reserve of strip material for the next interruption of the in-feed or until the in-feed is stopped altogether to replenish the source of supply.

It will be appreciated that the difference between the length of strip material S as when the guide basket assemblies are fully expanded to the position seen in phantom lines in FIGS. 1 and 2 and when fully contracted to the position seen in solid lines in FIGS. 1 and 2 determines the maximum reserve storage capacity of the accumulator.

Description of the FIGS. 5 and 6 Alternative Form of Guide Basket Assembly

Referring now to FIGS. 5 and 6, another form of guide basket assembly is designated generally by reference numeral 100. The guide basket assembly 100 constitutes an alternative form that may be used in place of the aforedescribed basket assembly 21. Like the basket assemblies 21, a plurality of basket assemblies 100 would be circumferentially arranged and uniformly radially movable with respect to the central vertical axis of the accumulator and together contain, support and guide the strip material along a spiral path.

Each guide basket assembly 100 comprises a guide roll support carriage 101 which includes a vertical side plate 102 and radially spaced pairs of parallel vertical plates 103. The vertical plates 103 extend laterally from a common side of the side plate and form therewith a common oblique angle. Extending laterally from the side of the side plate opposite the vertical plates is a torque arm 105 which has a roller 106 secured at its distal end. The axis of the roller extends laterally and perpendicularly to a radius of the accumulator. Gussets 107 and 108 may be provided to rigidify the support arm as may top plates 109 and 110 which rigidify the vertical plates 103.

The guide roll support carriage 101 is supported for radial movement on a drive worm 112 and a rail 113 which is parallel to and laterally spaced from the drive worm. The rail 113 may extend along a radius of the accumulator whereas the drive worm preferably is laterally offset and parallel to such radius.

As shown, the radially spaced pairs of plates 103 of the carriage 101 ride on the core shaft 114 of the drive worm 112 as by rollers 115 journaled between the lower ends of the vertical plates of each pair. Preferably, the lower edge of each vertical plate has an arcuate recess 116 which accommodates the core of the drive worm, and the rollers 115 secured to each pair of side plates are disposed on opposite sides of a vertical plane passing through the worm axis 117 as seen in FIG. 6. On the other hand, the torque arm 105 is supported on the rail 113 by the roller 106 which rides on the top flange of the rail. In addition, a roller 118 mounted for rotation at the lower end of depending bracket 119 secured to the torque arm bears against the underside of the top flange of the rail to hold the torque arm to the rail so as to prevent the support carriage 101 from rotating along with the drive worm.

As best seen in FIG. 5, the radially spaced pairs of vertical plates 103 ride respectively between adjacent turns of the worm ridge 120 and each plate is pitched to the worm axis at the pitch angle of the worm ridge. In addition, the plates may have rollers 121 secured to their lower ends which rotate about vertical axes and project slightly beyond the plates 103 so that the plates ride on the side faces of the worm ridge. In essence, the plates 103 and associated rollers function as a rack in mesh with the worm. Accordingly, upon rotation of the drive worm, the side plates, and thus the carriage 101, will be moved longitudinally along the drive worm and thus generally radially with respect to the central axis of the accumulator.

Although not shown in FIGS. 5 and 6, a suitable drive may be provided for uniformly rotating the drive worms 112 to effect uniform radial movement of the circumferentially arranged guide basket assemblies 100. One form of drive assembly that may be employed to effect uniform rotation of the drive worms is described hereinafter in conjunction with the FIG. 7–11 embodiments.

Still referring to FIGS. 5 and 6, the guide basket assembly 100 further comprises, for each pair of vertical plates 103, a pair of vertical guide rolls 123 which are radially in line with respect to the worm axis 117 and closely spaced to contain and guide the strip material S in a narrow path therebetween. The guide rolls are mounted between upper and lower end supports 124 and 125 which are secured to the vertical plates. A radially extending lower strip edge support roll 126 may be journaled between the vertical plates horizontally in line with the lower ends of the vertical guide rolls 123. The axis of such edge support roll is normal to the axis of the vertical guide rolls. Accordingly, the vertical guide rolls and edge support rolls support and contain adjacent turns of the strip material in radially spaced relationship. To accommodate the strip turns guided by the guide rolls 123, the upper portion of the side plate 102 may be provided with slots 127.

Figure 7:
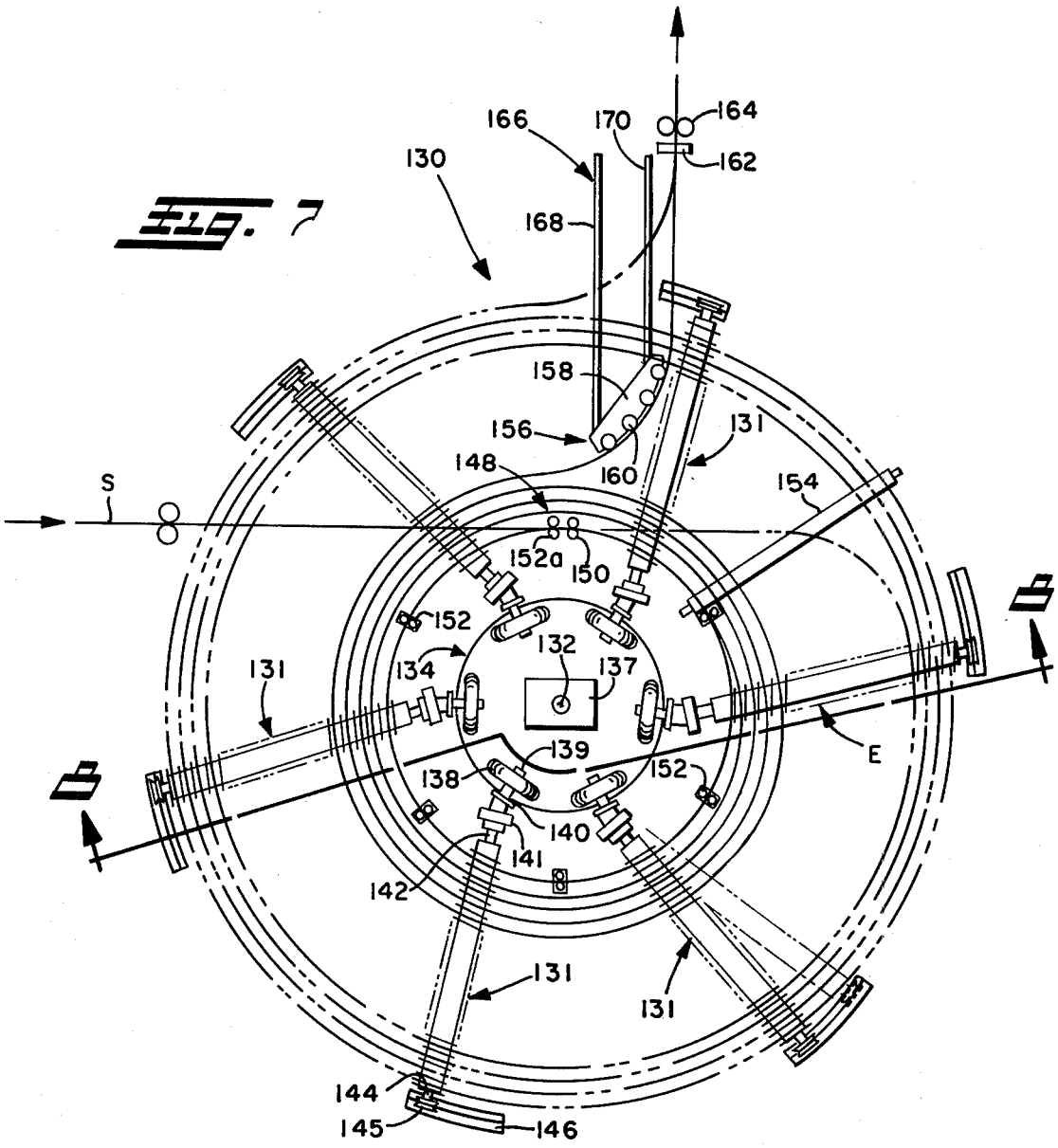
FIG. 7 is s schematic plan view of another preferred embodiment of strip accumulator according to the invention.
Figure 8:
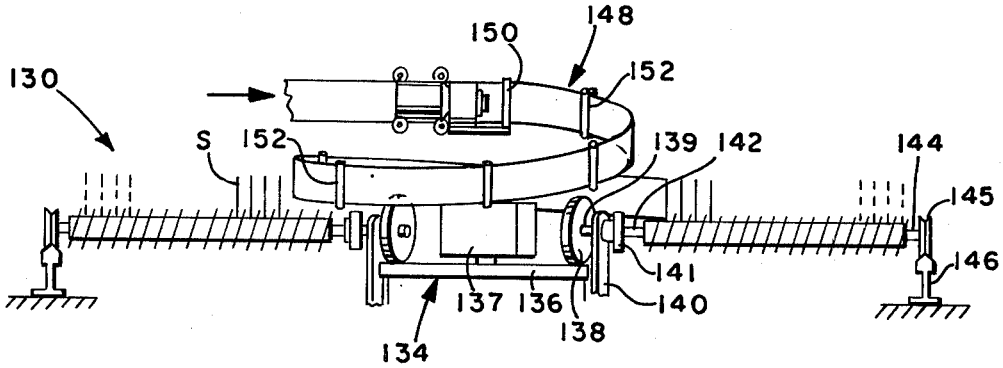
FIG. 8 is a schematic vertical section through the accumulator of FIG. 7 taken substantially along the line 8—8 thereof.

Description of the FIGS. 7 and 8 Embodiment

Referring now to FIGS. 7 and 8, another embodiment of accumulator according to the invention is designated generally by reference numeral 130. The accumulator 130 comprises a plurality of strip guide assemblies which here are in the form of strip guide and support worms or screws that are commonly identified by reference numeral 131. The strip guide and support worms 131 are circumferentially arranged and extend generally radially with respect to the central vertical axis 132 of the accumulator. Together the worms support, contain and guide the strip along a spiral path with adjacent turns of the strip being maintained in radially spaced relation by the turns of the worm. A common drive assembly 134 uniformly rotates the worms to effect radial expansion and contraction of the spiral path, or more accurately the spiral coil of strip supported and guided along such path by the worms.

The number of turns of strip S supported on the guide and support worms 131 may vary depending on the desired capacity of the accumulator, it of course being understood that the number of turns must be fewer in number than the available number of worm turns which guide and contain the strip so that the strip coil can be radially expanded and contracted. Given a fixed number of turns, the maximum reserve capacity of the accumulator is determined by the difference between the length of the strip coil when fully expanded to the radially outer ends of the worms and when fully contracted to the radially inner ends of the worms. In addition, the number of worms 131 may vary depending for example on the size and type of strip material to be used.

As indicated, the drive assembly 134 uniformly rotates the worms 131 to effect expansion and contraction of the spiral coil of strip. The drive assembly may comprise a drum or turntable 136 mounted for rotation about the central vertical axis 132 of the accumulator. Rotation of the drum in either diretion may be effected by a drive motor 137 which may be drivingly connected to the drum through a gear reducer.

The drum 136 has a flat top surface on which rides rubber tires 138, there being provided a rubber tire for each worm 131. Each rubber tire is mounted on a wheel which has its axle 139 extending radially with respect to the central axis 132 and journaled in an axle support 140. The axle 139 may be drivingly connected by a universal joint 141 to the shaft end 142 of the corresponding worm. Accordingly, rotation of the drum causes the worms to rotate uniformly in the same direction. It can also be seen that the axle support, axle and universal joint support the radially inner end of the worm.

The universal joints 141 preferably are employed so that each worm 131 may be skewed or canted slightly to a radius of the accumulator, and hence to the wheel axle 139. By thusly skewing the worms, the pitch lines thereof may be made substantially parallel to the strip supported on the worms thereby to reduce rubbing between the strip and worm as the strip moves along the strip path. The worms further may be mounted for limited rotation or swinging movement about a vertical axis through the universal joint, this permitting the pitch line of the worm to remain essentially parallel to the strip as the spiral coil expands and contracts. As shown, the radially outer shaft end 144 of the worm may have journaled thereon a roller 145 which rides on a short arcuate track or rail 146. During expansion and contraction of the strip coil, the forces resulting from any rubbing between the strip and worm will rotatably swing the worm between the illustrated solid line and phantom line positions thereof so as to minimize such rubbing.

As seen in FIGS. 7 and 8, strip material S may be fed onto the guide worms 131 by an entry support cage 148 which may be similar to the entry support cage 24 of the accumulator shown in FIGS. 1 and 2. The entry support cage 148 includes a pair of feed-in or pinch rollers 150 which are sufficiently elevated above the guide worms 131 so that incoming strip clears the worms positioned therebeneath. Also, one or more pairs of guide idler rolls numeral 152 may be provided circumferentially spaced around the axis of the accumulator.

The last pair of idler rolls **152*a* may be positioned about one quarter turn before the guide worm onto which the incoming strip is fed, such being designated by the reference letter E in FIG. 7. After passing through the last pair of idler rolls, the strip is free to float radially over such quarter turn thereof until it comes to be supported on the entry worm E. During radial expansion and contraction of the spiral coil of strip, the strip over such quarter turn is free to assume the proper arcuate path for tangential exiting from the entry support cage 148** and tangential entry into the spiral path of the accumulator at the entry worm E.

As seen in FIG. 7, a support roll 154 may be provided to support the strip over such free floating quarter turn thereof so that no permanent deformation of the strip will occur. If desired, the roll 154 may be replaced by a series of small rolls. Alternatively, a screw having a reduced outer diameter may be substituted for the roll. The screw may be set so that its outer diameter just clears the lower edge of the strip supported on the support and drive worms yet sufficiently high enough to engage the incoming strip from the entry support cage 148, or more particularly, the last pair of guide idler rollers **152*a*** which may be set to support the strip thereat at a level slightly lower than that of the strip supported on the guide worms. Accordingly, the strip over such one quarter turn will be engaged by the screw which can be rotated to urge such one quarter turn to the proper arcuate path thus to prevent a sharp kink in the strip between the helix exit and the beginning of the inner traveling turn of the strip supported on the worms.

The accumulator also may be provided with an exit roll guide 156. The exit roll guide 156 includes a frame 158 and an arcuate array of rolls 160 mounted in such frame. Also, one or more lower strip edge support rolls 162 and a pair of pinch rolls 164 may be provided in line with the exit end of the exit roll guide. The frame 158 is supported and guided for substantial radial movement on a track 166 consisting of two parallel rails 168 and 170. The frame may be driven along the track by suitable means in such a manner that the arcuate path defined by the rolls terminates in substantially tangential alignment with the exit of the oppositely curving spiral path defined in the accumulator as such spiral path radially expands and contracts. The pinch rolls also may be controllably driven by a motor (not shown) to provide a back tension for the mill, and may be arranged similarly to those of the strip exit assembly of the accumulator of FIGS. 1 and 2.

Operation of the FIGS. 7 and 8 Embodiment

The accumulator 130 may initially be loaded by feeding the strip material first between the feed-in rolls 150 of the strip entry support cage 148 to provide a driving force for feeding the strip material into the accumulator. From the feed-in rolls, the strip material is guided along the helical entry path by the idler rolls 152 onto the entry guide worm E. From the entry guide worm E, the strip material is formed into a coil of the desired number of turns on the guide worms 131, each adjacent turn being maintained in radially spaced relation by the turns of the guide worms. After the desired number of turns have been formed, the leading end of the coil is guided along the exit guide rolls 160 to and between the pinch rolls 164 and then onto the mill, machine or other apparatus for processing of the strip material. If the spiral coil of strip is formed in its radially expanded condition, the accumulator would then be fully loaded. Otherwise, additional strip material may be fed into the accumulator as the guide worms are uniformly rotated and urge the spiral coil to its fully expanded condition shown in phantom lines in FIGS. 7 and 8.

Once loaded, the normal operation of the accumulator 130 is essentially the same as that of the accumulator 20 of FIGS. 1 and 2. However, instead of uniformly radially moving guide basket assemblies to reduce and increase the respective diameters of the stored turns so as to supply or accumulate strip material, the guide worms 131 instead are uniformly rotated.

Figure 9:
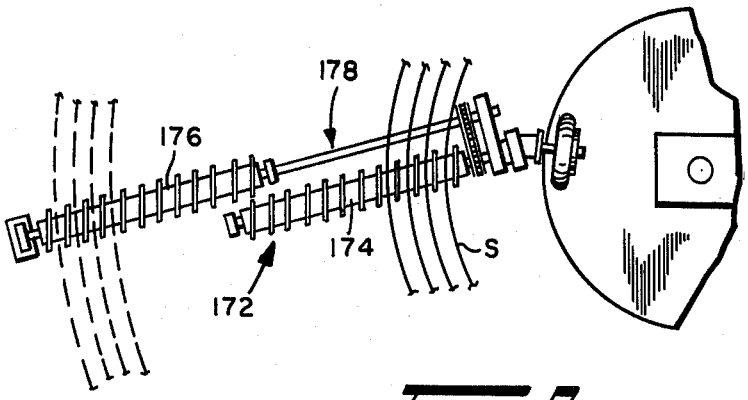
FIG. 9 is a fragmentary schematic top plan view of a modified form of the FIG. 8 strip accumulator.
Figure 10:
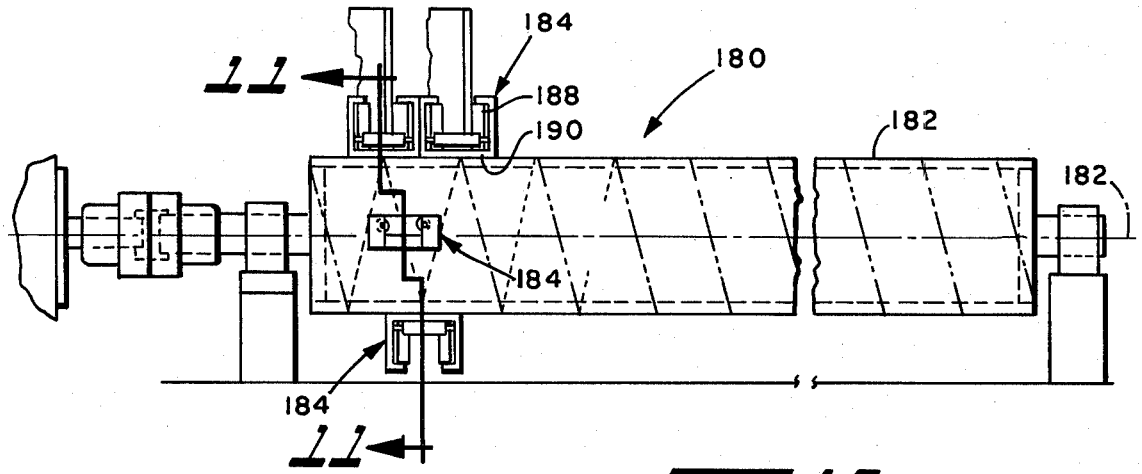
FIG. 10 is a fragmentary elevation view of a preferred form of strip guide and support worm.
Figure 11:
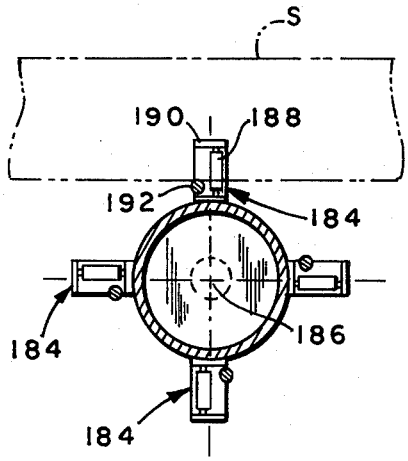
FIG. 11 is a vertical section through the strip guide and support worm of FIG. 10 taken substantially along the line 11—11 thereof.

Description of the FIGS. 9–11 Alternative Forms of Strip Guide and Support Worm Referring now to FIG. 9, there is shown an alternative form of guide and support worm 172 that reduces undesirable rubbing resulting from relative movement of the strip S and worm. As shown, the worm 172 may consist of two (or more) drivingly interconnected worm segments 174 and 176. The worm segments are radially and circumferentially staggered so that the pitch lines thereof essentially will be parallel to the strip supported thereon. The radially innermost segment 174 may be drivingly connected to the drive assembly in the above indicated manner whereas the respective radially outer segment 176 may be drivingly connected to the innermost segment, such as by the drive shaft and chain drive assembly 178, for common rotation of the worm segments. With this arrangement, the worm 172 need not be mounted for limited rotation about a vertical axis as was preferred with the worm 131.

Although the worms or worm segments of the accumulator may be of conventional form as schematically illustrated in FIGS. 7–9, i.e., cylindrical shafts having a continuous advancing spiral worm ridge threaded around its outside surface, they have the objection that unavoidable rubbing would occur between the worms and the circumferentially moving strip. A preferred form of guide and support worm which does not suffer this drawback is illustrated at 180 in FIGS. 10 and 11, and will now be described.

Such guide and support worm 180 may include a cylindrical shaft 182 and a plurality of roll assemblies 184 which are helically arranged around the outside surface of the shaft. As shown, the roll assemblies 184 are located every 90° about the shaft whereby every fourth assembly is adjacent to the next fourth assembly along the longitudinal axis 186 of the shaft.

Each roll assembly 184 includes a pair of parallel guide rolls 188 which are axially in line with respect to the longitudnal axis 186 of the shaft 182 and closely spaced to contain and guide the strip material S in a narrow path therebetween. The guide rolls extend radially with respect to the shaft and are mounted in a C-shape frame 190 secured at its closed side to the outer surface of the shaft. The guide assembly further includes a lower strip edge support roll 192 which is mounted between the radially extending sides of the C-frame adjacent the radially inner ends of the guide rolls 188 with its axis parallel to the axis of the shaft as indicated.

The edge support rolls 192 of the roll assemblies 184 should be sufficiently radially outwardly spaced from the outer surface of the shaft 182 such that as the worm rotates, at least one edge support roll of an assembly is always supporting the lower edge of a respective strip turn and keeping it from rubbing on the shaft. Moreover, the guide rolls 188 should be of sufficient length so that each turn of the spiral coil is contained and guided between the guide rolls of at least one of the helically arranged assemblies as the worm rotates. Accordingly, rotation of the worm will cause successive guide assemblies to support and capture the strip turns and urge same radially inwardly or outwardly depending on the rotational direction. It thus can be seen that the assemblies 184 constitute a discontinuous worm thread which performs the same function as a continuous worm thread but without undesirable rubbing.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the following claims.

What is claimed is:

1. An accumulator for storing a variable length of strip material comprising a plurality of circumferentially spaced strip guide means positively defining a spiral path for a plurality of turns of strip material with adjacent turns thereof being radially spaced apart, and means for uniformly moving said guide means to effect radial expansion and contraction of the spiral strip path wherein each strip guide means includes a radially moveable guide basket having mounted therein a plurality of radially spaced strip guides which guide and contain the strip material along the spiral path and maintain adjacent turns of the strip material radially space apart.

2. An accumulator as set forth in claim 1 wherein said radially spaced strip guides consist of closely radially spaced vertical guide rolls.

3. An accumulator as set forth in claim 2 wherein each guide basket further has mounted therein a radial roll at the lower ends of and spanning adjacent vertical rolls for supporting the lower edge of the strip material passing between adjacent vertical rolls.

4. An accumulator as set forth in claim 1 wherein each guide basket is mounted for radial movement on a radially extending track.

5. An accumulator as set forth in claim 4 wherein said means for uniformly moving includes a drive for each guide basket and a single drive motor common to said drives.

6. An accumulator as set forth in claim 5 wherein each said drive includes a capstan and bi-directional cable means interconnecting each said capstan to the corresponding guide basket for effecting radial movement of the guide baskets upon rotation of said capstan.

7. An accumulator as set forth in claim 1 wherein said means for uniformly moving includes means operative to move said guide basket radially outwardly and for placing a drag on said guide basket during radially inward movement thereof.

8. An accumulator as set forth in claim 1 wherein such spiral strip path includes an entry and an exit, and feed-in means are provided for feeding incoming strip material into such spiral path at such entry, and withdrawal means are provided for withdrawing strip material from such spiral path at said exit.

9. An accumulator as set forth in claim 8 wherein said feed-in or withdrawal means includes a pair of pinch rollers.

10. An accumulator as set forth in claim 8 wherein said feed-in or withdrawal means includes means for guiding the strip material into or out of the accumulator along an arcuate path terminating in tangential alignment with the spiral path at said entry or exit.

11. An accumulator as set forth in claim 8 wherein said means for guiding the strip material into or out of the accumulator includes a last or first fixed strip guide circumferentially spaced from the entry or exit of the accumulator a sufficient arcuate distance so that the strip entering or exiting the spiral strip path may freely radially float as the strip path is radially expanded and contracted without permanent deformation of the strip.

12. An accumulator as set forth in claim 11 wherein said means for guiding the strip material into or out of the accumulator further includes a radially movable entry or exit idler guide basket arranged circumferentially between said last or first fixed strip guide and said entry or exit for supporting the freely radially floating strip.

13. An accumulator as set forth in claim 12 wherein said entry or exit idler guide basket is mounted for free radial movement on a radially extending track.

14. An accumulator as set forth in claim 13 wherein said entry or exit idler guide basket includes a pair of closely radially spaced vertical rolls for containing the strip material therebetween and a radial roll at the lower ends of and spanning said vertical rolls for supporting the lower edge of the strip material passing between said vertical rolls.

15. An accumulator as set forth in claim 8 wherein said feed-in or withdrawal means includes a helix support cage for guiding the strip in a single helical turn.

16. An accumulator as set forth in claim 1 wherein said means for uniformly moving includes a radially extending drive worm for each guide basket and means for uniformly rotating said drive worms, and each guide basket includes rack means in mesh with the corresponding drive worm.

17. An accumulator as set forth in claim 16 wherein each guide basket is mounted for radial movement on the corresponding drive worm.

18. An accumulator as set forth in claim 17 including a rail for each guide basket parallel to the corresponding drive worm, and wherein each guide basket has a torque arm riding on and held to the corresponding rail for preventing rotation of the guide basket along with the drive worm.

19. An accumulator as set forth in claim 16 wherein said rack means includes radially spaced pairs of vertical plates adapted to ride respectively between adjacent turns of the drive worm.

20. An accumulator as set forth in claim 19 wherein said radially spaced strip guides consist of closely spaced vertical guide rolls journaled on said vertical plates.

21. An accumulator as set forth in claim 20 wherein each guide basket further includes a radial roll journaled between each pair of vertical plates horizontally in line with and spanning the lower ends of corresponding vertical rolls for supporting the lower edge of the strip material passing between such vertical rolls.

22. An accumulator as set forth in claim 19 wherein said vertical plates are pitched to the axis of said drive worm at the pitch angle of said drive worm.

23. An accumulator as set forth in claim 22 wherein said vertical plates are supported by rollers on the core shaft of said drive worm.

24. An accumulator as set forth in claim 23 wherein said vertical plates have rollers journaled thereon which bear against respective side faces of the drive worm ridge.

* * * * *